US006100749A

United States Patent [19]

Itoh

[11] Patent Number: 6,100,749

[45] Date of Patent: Aug. 8, 2000

[54] CURRENT SOURCE CIRCUIT

[75] Inventor: Masashi Itoh, Yokohama, Japan

[73] Assignee: Kabushiki Kaisha Toshiba, Kawasaki, Japan

[21] Appl. No.: 09/046,787

[22] Filed: Mar. 24, 1998

[30] Foreign Application Priority Data

Mar. 25, 1997 [JP] Japan ..... 9-071181

[51] Int. Cl.[7] ..... G05F 3/02

[52] U.S. Cl. ..... 327/530; 323/312; 323/315

[58] Field of Search ..... 323/312, 313, 323/315; 327/530, 560, 575, 577, 403, 405, 538, 543

[56] References Cited

U.S. PATENT DOCUMENTS

| | | | |
|---|---|---|---|
| 5,126,653 | 6/1992 | Ganesan et al. | 327/530 |
| 5,140,181 | 8/1992 | Yoshino | 327/577 |
| 5,838,188 | 11/1998 | Taguchi | 327/530 |

*Primary Examiner*—Jung Ho Kim

*Attorney, Agent, or Firm*—Oblon, Spivak, McClelland, Maier & Neustadt, P.C.

[57] ABSTRACT

A current source circuit includes a series-circuit connected between a power source node and ground and comprising a reference current source circuit, a first transistor Q1 of an NPN type having its collector and base connected to each other and a second transistor Q2 having a multi-emitter area (N) and having a multi-emitter configuration. The current source circuit further includes a third transistor Q3 of an NPN type connected at its collector to the power source node, at its base to the base of the first transistor Q1 and at its emitter connected to the base of the second transistor and has an emitter area (M) and an input current source circuit connected between the emitter of the third transistor Q3 and ground to allow a flow of an input current Iin. The current source circuit still further includes a fourth transistor Q4 of an NPN type connected at its collector-to-emitter circuit between a current output node and the ground and at its base connected to the collector of the second transistor to allow a flow of an output current Iout. Relative to an input current Iin, the output current Iout is proportional to the reciprocal of a product (M×N) of emitter areas of the third transistor Q3 and second transistor Q2.

8 Claims, 4 Drawing Sheets

CURRENT SOURCE CIRCUIT

BACKGROUND OF THE INVENTION

The present invention relates to a current source circuit formed in a semiconductor integrated circuit (IC) and, in particular, to a bipolar type very small current source circuit, demanding an output current of high accuracy, which is used as a current source of an electronic circuit for application to an automobile, home electric appliance, industrial machine and equipment.

A conventional bipolar type very small current source circuit as shown in FIG. 1 is represented by a power source node 21 supplied with a current source voltage Vcc, a current output node 22 (a current drawing node in this example) to which a load circuit is connected, and ground GND, in which an input current source circuit 23 and first NPN transistor Q1 of a multi-emitter configuration are connected, in a series array, between the current source node 21 and the GND, the input current source circuit 23 supplying an input current Iin and the first NPN transistor Q1 having its collector and base connected to each other, its collector connected to an output of the input current source circuit 23 and its multi-emitter side connected to the GND.

Further, a collector-to-emitter circuit of a second NPN transistor Q3 is connected between the current output node 22 and the GND and has its base connected to the base of the transistor Q1.

In the current source circuit above, the collector current in the transistor Q1 is substantially Iin and if, in this case, those emitter areas A1 and A2 of these transistors Q1 and Q3 are given as a ratio of K (integer):1, then an output current Iout flowing through the transistor Q3 and output node 22 is given as $$Iout=Iin/K.$$

It is necessary that, in order to obtain a very small output current Iout in a current attenuation circuit for instance, the emitter area ratio K:1 be made greater. In order to set K=25 for instance, the pattern size of the transistor Q1 becomes considerably greater (size corresponding to 25 transistors) and, correspondingly, the size of the IC chip becomes considerably greater.

A very small current source circuit of FIG. 2 constituting another prior art circuit is represented by a power supply node 11 supplied with a power source voltage Vcc, current output node 12 (current drawing node in this example) connected to a load circuit, and ground GND. Between the power source node 11 and the GND is connected a series circuit of a reference current source circuit 13 supplied with a reference current Iref, a collector-to-emitter circuit of a first NPN transistor Q1 having its collector and base connected to each other, and a collector-to-emitter circuit of a second NPN transistor Q2.

Further a collector-to-emitter circuit of a third NPN transistor Q3 and resistive element R are connected, in a series array, between the power source node 11 and the GND.

The base of the transistor Q1 is connected to that of the transistor Q3 and the base of the transistor Q2 is connected to the emitter of the transistor Q3.

Further, a collector-to-emitter circuit of a fourth NPN transistor Q4 is connected between the current output node 12 and the GND. The base of the transistor Q4 is connected to the collector of the transistor Q2.

In the current source circuit above, the base-to-emitter forward voltage of the transistor Q1 is represented by VBEQ1, base-to-emitter forward voltage of the transistor Q2 by VBEQ2, base-to-emitter forward voltage of the transistor Q3 by VBEQ3 and base-to-emitter forward voltage of the transistor Q4 by VBEQ4 and collector current (output current) of the transistor Q4 by Iout, then a potential Vx on the base of the transistor Q4 is given by:

$$\begin{aligned}
Vx &= VBEQ2+VBEQ3-VBEQ1\\
&= VT\cdot 1n\{Iref/(\beta\cdot Is)\}+VT\cdot 1n\{VBEQ2/(R\cdot\beta\cdot Is)\}-VT\cdot 1n\{Iref/(\beta\cdot Is)\}\\
&= VT\cdot 1n[\{Iref/(\beta\cdot Is)\}^{*}\ \{VBEQ2/(R\cdot\beta\cdot Is)\}^{*}\ \{\beta\cdot Is/Iref\}]\\
&= \mathrm{VT}\cdot 1n\{VBEQ2/(R\cdot\beta\cdot Is)\}\\
&= VT\cdot 1n\{Iout/(\beta\cdot Is)\}
\end{aligned} \tag{1}$$

Here, VT: thermal voltage

β: current amplification factor

Is: saturation current

From the equation (1) the following equation (2) is found:

$$Iout=VBEQ2/R \tag{2}$$

That is, the output current Iout is proportional to the reciprocal (1/R) of the resistive value of the resistive element R. In order to obtain a very small output current Iout, it is only necessary to make the resistive value of the resistive element R greater. In this case, however, the pattern size of the resistive element R is made considerably greater and hence the size of the IC chip becomes considerably bulkier.

The conventional current source circuit above has the drawback in that, in order to obtain a very small output current, the pattern size of those elements used becomes considerably greater and hence the size of the IC chip becomes considerably greater.

BRIEF SUMMARY OF THE INVENTION

It is accordingly the object of the present invention to provide a current source circuit which is simpler in construction and can precisely obtain a very small output current while suppressing the size of an integrated circuit as well as the pattern size of elements used.

In order to achieve the above-mentioned object, there is provided a current source circuit comprising:

- a series-circuit connected between a power source node and ground and comprised of a reference current source circuit, a first transistor Q1 of NPN type having its collector and base connected to each other and a second transistor Q2 of a multi-emitter configuration having an emitter area (N);
- a third transistor Q3 of an NPN type connected at its collector connected to the power source node, at its base connected to the base of the first transistor Q1 and at its emitter to the base of the second transistor Q2 and having an emitter area (M);
- an input current source circuit connected between the emitter of the third transistor Q3 and the ground to provide an input current Iin; and
- a fourth transistor Q4 of an NPN type having its collector-to-emitter circuit connected between a current output node and the ground and its base connected to the collector of the second transistor Q2 to provide an output current Iout, wherein, relative to an input current Iin, the output current Iout is proportional to a reciprocal of a product (M×N) of the emitter areas of the second and third transistors Q2 and Q3.

Further, a current source circuit is provided, comprising:

a first transistor Q1 of a PNP type having its emitter connected to a power source node and its collector and base connected to each other;

a second transistor Q2 of an NPN type having its collector-to-emitter circuit connected between the collector of the first transistor Q1 and ground and being a multi-emitter configuration having an emitter area (N);

a third transistor Q3 of a PNP type connected at its emitter to the power source node and at its base connected to the base of the first transistor Q1;

a fourth transistor Q4 of an NPN type having its collector-to-emitter circuit connected between the collector of the third transistor Q3 and the ground and its collector and base connected to each other;

a fifth transistor Q5 of an NPN type connected at its base connected to the base of the fourth transistor Q4, its emitter connected to the ground and its collector connected to the base of the second transistor Q2 and being a multi-emitter configuration having an emitter area (M);

an input current source circuit connected between the power source node and the collector of the fifth transistor Q5; and a sixth transistor Q6 of an NPN type having its collector-to-emitter circuit between a current output node and the ground and its base connected to the collector of the fifth transistor and serving as a current output transistor; wherein relative to an input current Iin, an output current Iout is proportional to the reciprocal of a product (M×N) of those emitter areas of the second and fifth transistors Q2 and Q5.

Further, a current source circuit is provided, comprising:

a first group of n−1 transistors (Q1, Q2, . . . , Qn−1) of an NPN type having one end connected to an other end of a reference current source circuit having one end connected to a power source node, having their collector and base connected to each other, having their emitter area ratios L1 . . . Ln−1 and each having a multi-emitter configuration, these transistors being series-connected together and each providing a diode connection;

an output transistor Qn of a multi-emitter configuration having its collector-to-emitter circuit connected between a current output node and ground and its base connected to the emitter of the transistor Qn−1 at the other end of the first transistor group and having an emitter area ratio Ln, the output transistor Qn providing an output current Iout;

a second group of transistors (QA1, QA2, . . . , QAn) comprising a first transistor QA1 of an NPN type having its collector-to-emitter circuit connected between the emitter of the transistor Qn−1 at the other end of the first group of transistors and ground and having a multi-emitter configuration, an n-th transistor QAn of an NPN type having its collector connected to the power source node and its base connected to the base of one transistor of the first transistor group and having a multi-emitter configuration, and n−2 transistors of an NPN type having a multi-emitter configuration and Darlington-connected between the base of the first transistor QA1 and the emitter of the n-th transistor QAn, the second group of transistors (QA1, QA2, . . . , QAn) having their emitter area N1, N2, . . . , Nn, wherein the collector-to-emitter circuits of the second to (n−1)-st transistors (QA2, . . . , QAn−11) of the second transistor group are connected between the power source node and the ground;

an input current source circuits connected between the emitter of the n-th transistor QAn and the ground to provide an input current Iin; and n−2 bias current source circuits connected between the corresponding emitters of the second to the n−1 transistors (QA2, . . . , QAn−1) of the second transistors group and the ground, wherein, relative to the input current Iin, the output current Iout is proportional to a product (L1·L2, . . . , Ln) of those emitter area ratios of those diode-connected n−1 transistors Q1 to Qn−1 and output transistor Qn and proportional to the reciprocal of a product (N1·N2, ·. . . ·Nn−1·Nn) of the emitter area ratios of the second transistor group (QA1, QA2, . . . , QAn) where n represents an integer of over 2.

Still further, a current source circuit is provided, comprising:

a reference current source circuit having one end connected to a power source node;

a first group of n−1 transistors (Q1, Q2, . . . , Qn−1) of an NPN type having one end connected to the other end of the reference current source circuit, each having its collector and base connected to each other, and series-connected together as a diode connection each;

an output transistor Qn connected between a current output node and ground and connected at its base connected to the emitter of the transistor Qn−1 at the other end of the first transistor group to provide an output current Iout;

a second group of transistors (QA1, QA2, . . . , QAn) comprising a first transistor QA1 of an NPN type having a collector-to-emitter circuit connected between the emitter of the transistor Qn−1 at the other end of the first transistor group and ground, an n-th transistor QAn of an NPN type connected at its collector to the power source node and at its base connected to the base of one transistor of the first transistor group, and n−2 transistors of an NPN type Darlington-connected between the base of the first transistor QA1 and the emitter of the n-th transistor QAn, wherein the collector-to-emitter circuits of the second to the (n−1)-st transistors (QA2, . . . , QAn−1) of the second transistor group are connected between the power source node and the ground;

n−2 bias current source circuits connected between the corresponding emitters of the second to (n−1)-st transistors (QA2, . . . , QAn−1) of the second transistor group and the ground to provide those corresponding weighted currents (Iref/A2, Iref/A3, . . . , Iref/An−1 where A2, A3, . . . , An−1 represent the weighted factors); and an input current source circuit connected between the emitter of the n-th transistor QAn and the ground to provide an input current Iin, wherein the output current Iout is proportional to the reciprocal of a product (A2·A3·. . . ·An−1) of the weighted factors given to the n−2 bias current source circuits for allowing a flow of the corresponding weighted currents (Iref/A2, Iref/A3, . . . , Iref/An−1) relative to the input current Iout.

By doing so, the current source circuit of the present invention can be made simpler in arrangement and precisely obtain a very small output current while suppressing the pattern size of elements used as well as the size of an IC chip.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiments of the present invention will be explained below with respect to the accompanying drawing.

Figure 1:
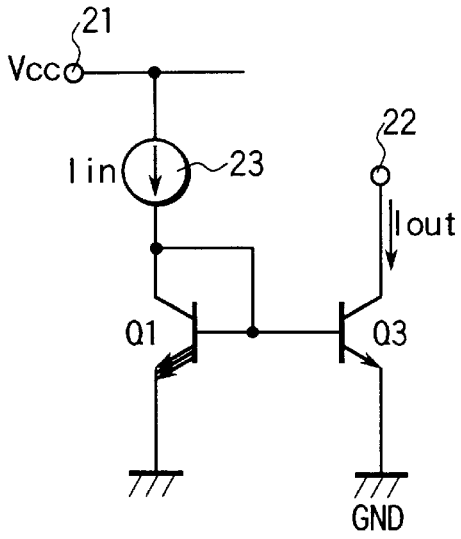
FIG. 1 PRIOR ART
FIG. 1 is a schematic view showing one example of a conventional current source circuit.
Figure 2:
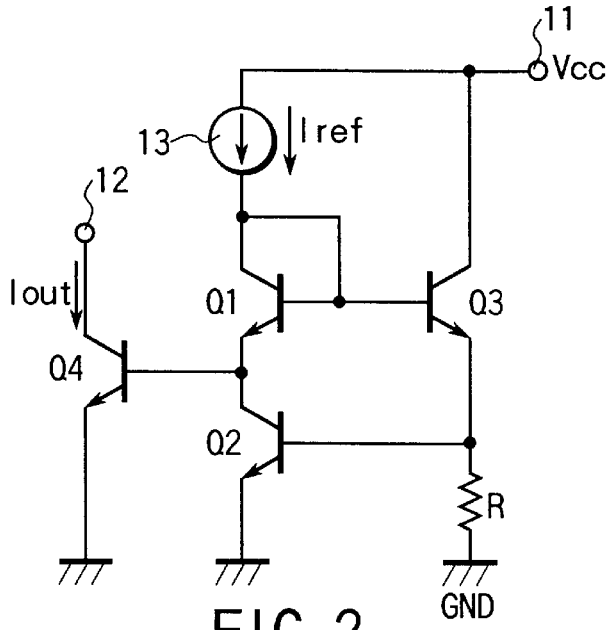
FIG. 2 PRIOR ART
FIG. 2 is a schematic view showing another example of a conventional current source circuit.
Figure 3:
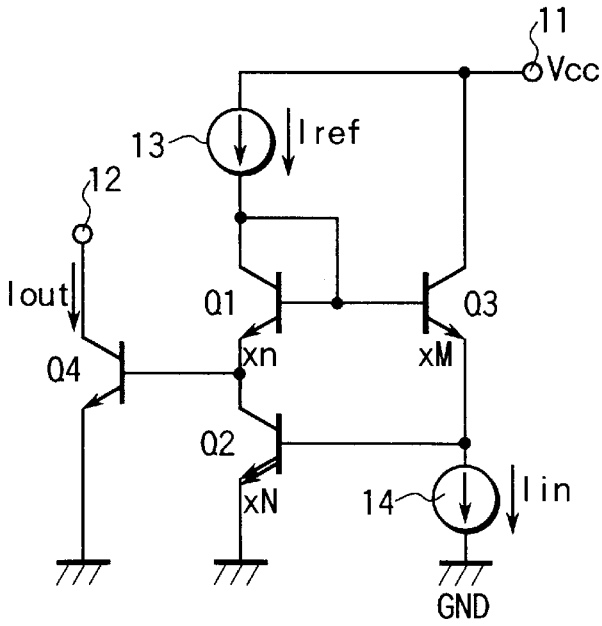
FIG. 3 is a schematic view showing a current source circuit according to a first embodiment of the present invention.

FIG. 3 shows an arrangement of a current source circuit according to a first embodiment of the present invention.

A current source circuit formed in an integrated circuit includes a power source node 11 supplied with a power source voltage Vcc, a current output node 12 (a current drawing node in this embodiment) connected to a load circuit, and a ground potential GND (hereinafter referred to simply as GND).

Between the power source node 11 and the GND is connected a series circuit of a reference current source circuit 13 supplied with a reference current Iref, a collector-to-emitter circuit of a first NPN transistor Q1 having its collector and base connected to each other and a collector-to-emitter circuit of a second NPN transistor Q2 of a multi-emitter configuration.

Further, between the power source node 11 and the GND is connected a series circuit of a collector-to-emitter circuit of a third NPN transistor Q3 of a multi-emitter configuration and an input current source circuit 14 for supplying an input current Iin.

The base of the transistor Q1 is connected to that of the transistor Q3 and the base of the transistor Q2 is connected to the emitter of the transistor Q3.

Further, the collector-to-emitter circuit of a fourth NPN transistor Q4 is connected between the current output node 12 and the GND and the base of the transistor Q4 is connected to the collector of the transistor Q2.

In the case where, in the current source circuit above, the emitter area of the transistor Q4 is set as a reference (=1), the emitter area of the transistor Q1 is set to n-fold, the emitter area of the transistor Q2 N-fold and the emitter area of the transistor Q3 M-fold.

If the base-to-emitter forward voltage of the transistor Q1 is represented by VBEQ1, base-to-emitter forward voltage of the transistor Q2 by VBEQ2, base-to-emitter forward voltage of the transistor Q3 by VBEQ3, base-to-emitter forward voltage of the transistor Q4, by VBEQ4, and collector current (output current) of the transistor Q4 by Iout, the base potential VBEQ4 of the transistor Q4 is given by:

$$\begin{aligned} VBEQ4 &= VBEQ2 + VBEQ3 - VBEQ1 \\ &= VT\cdot 1n\{Iref/(N\cdot\beta\cdot Is)\} + VT\cdot 1n\{Iin/(M\cdot\beta\cdot Is)\} - VT\cdot 1n\{Iref/(n\cdot\beta\cdot Is)\} \\ &= VT\cdot 1n[\{Iref/(N\cdot\beta\cdot Is)\}^{*}\ \{Iin/(M\cdot\beta\cdot Is)\}^{*}\ \{n\cdot\beta\cdot Is/Iref\}] \\ &= \mathrm{VT}\cdot 1n\{n\cdot Iin/(M\cdot N\cdot\beta\cdot Is)\} \\ &= VT\cdot 1n\{Iout/(\beta\cdot Is)\} \end{aligned} \tag{3}$$

Here, VT: thermal voltage

β: current amplification factor

Is: saturation current

From the above equation (3), the following equation is found:

$$Iout = \{n/(M\cdot N)\}\cdot Iin \tag{4}$$

When n=1, $$Iout = \{1/(M\cdot N)\}\cdot Iin \tag{5}$$

That is, with respect to the input current Iin, the output current Iout is proportional to the reciprocal of the product (M·N) of the emitter areas of the two transistors of a multi-emitter configuration.

In order to obtain a very small output current Iout, it is only necessary to set the product. (M·N) of the emitter area greater. For example, at M=5 and N=5 (corresponding to the pattern size of 10 transistors), it is possible to set 1/(M·N)= 1/25. In this connection, the M and N, exceeding 1, may be non-integer. If, for example, M=6.5 and N=2, then a prime number, such as M·N=13, can be set. Further, if M=6.5 and N=3, then any arbitrary number, such as M·N=19.5, can be set.

That is, according to the current source circuit shown in FIG. 3, by subtracting the base-to-emitter forward voltage VBEQ1 (a fixed value) of the transistor Q1 from a sum of a small base-to-emitter forward voltage VBEQ2 of the transistor Q2 of a multi-emitter configuration and small base-to-emitter forward voltage VBEQ3 of the transistor Q3 of a multi-emitter configuration, the base-to-emitter forward voltage VBEQ4 of the transistor Q4 for current outputting is suppressed to a lower extent and a very small output current Iout is obtained.

By doing so, it is possible to, being simpler in structure, suppress the pattern size of the transistors used and size of the IC chip and thereby to precisely obtain a very small output current.

Figure 4:
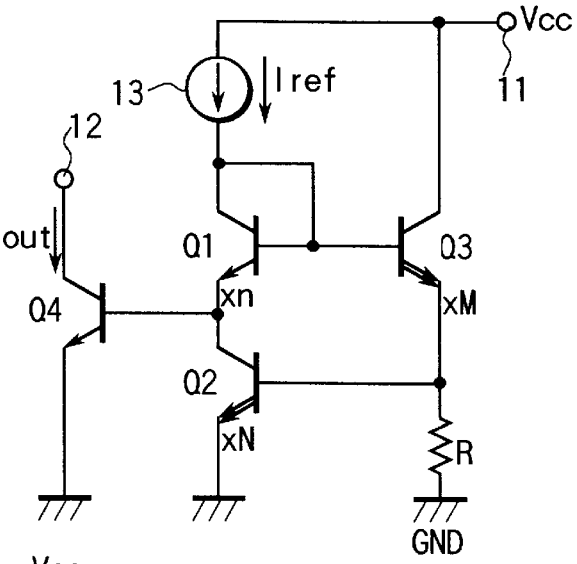
FIG. 4 is a schematic view showing a current source circuit according to a second embodiment of the present invention.

FIG. 4 shows a circuit arrangement showing a current source circuit according to a second embodiment of the present embodiment.

The second embodiment is different from the first embodiment of FIG. 3 with respect to using a resistive element R in place of the input current source circuit 14. The remaining portion of FIG. 4 is the same as that of FIG. 3 and any further explanation is, therefore, emitted with the same reference numerals employed to designate parts or elements corresponding to those shown in FIG. 3.

In the current source circuit shown, the following equation is established.

$$VBEQ4=VBEQ2+VBEQ3-VBEQ1$$

$$VT\cdot 1n\{Iref/(N\cdot\beta\cdot Is)\}+VT\cdot 1n\{VBEEQ2/(R\cdot M\cdot\beta\cdot Is)\}-VT\cdot 1n\{Iref/(n\cdot\beta\cdot Is)\}$$

$$=VT\cdot 1n[\{Iref/(N\cdot\beta\cdot Is)\}*\{VBEQ2/(R\cdot M\cdot\beta\cdot Is)\}*\{n\cdot\beta\cdot Is/Iref\}]$$

$$=VT\cdot 1n\{n\cdot VBEQ2/(R\cdot M\cdot N\cdot\beta\cdot Is)\}$$

$$=VT\cdot 1n\{Iout/(\beta\cdot Is)\} \quad (6)$$

$$\therefore Iout=n\cdot VBEQ2/(R\cdot M\cdot N)$$

When n=1, $$Iout=VBEQ2/(R\cdot M\cdot N) \quad (7)$$

An output current Iout is proportional to the reciprocal of a value obtained by multiplying a resistive value of the resistive element by M·N. In order to obtain a very small output current Iout, it is possible to minimize the pattern size of the resistive element R when, for example, N=5 and M=5.

In this connection it is to be noted that another resistive element can be connected between the emitter of a first transistor Q1 and the collector of a second transistor Q2.

Since the current source circuits shown in FIGS. 3 and 4 are of such a type that those base-to-emitter circuits of NPN transistors Q3 and Q2 are connected, in a two-stage direct-connected configuration, between the power source node 11 and the GND to provide two base-to-emitter voltages VBE, a voltage of over 2VBE (at least over 1.8V) is required as the operation power source. Therefore, the resultant power source circuit cannot be applied to an integrated circuit which is mounted on an electronic device capable of operating with a low power source voltage of a battery of, for example, below 1.5V.

With these situations in view, an explanation will be given below about a current source circuit operable under a low power source voltage of below 1.5V such as a voltage of about 0.9V.

Figure 5:
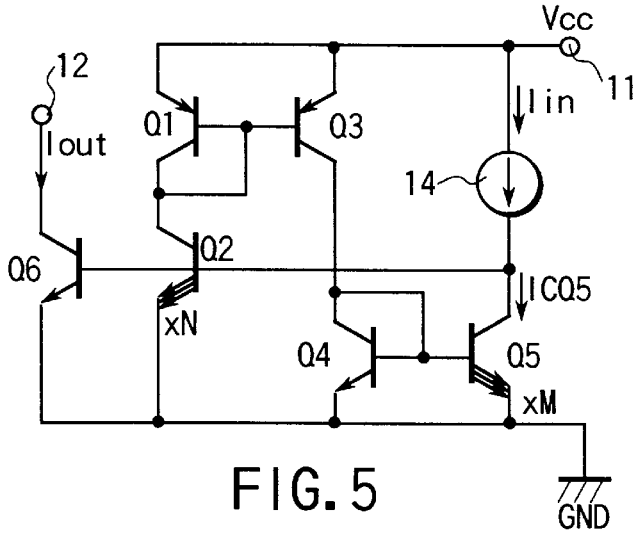
FIG. 5 is a schematic view showing a current source circuit according to a third embodiment of the present embodiment.

FIG. 5 shows a circuit arrangement of a current source circuit according to a third embodiment of the present invention. The emitter-to-collector circuit of a first transistor Q1 of a PNP type having its collector and base connected together and collector-to-emitter circuit of a second transistor Q2 of an NPN type having a multi-emitter configuration are series-connected together between a power source node 11 and GND.

An emitter-to-collector circuit of a third transistor Q3 of a PNP type having its base connected to the base of the transistor Q1 and collector-to-emitter circuit of a fourth transistor of an NPN type having its collector and base connected together are series-connected together between the power source node 11 and the GND.

An input current source circuit 14 flowing an input current Iin therein and collector-to-emitter circuit of a fifth transistor Q5 of an NPN type connected at its base to the base of the transistor Q4 and having a multi-emitter configuration are series-connected together across the power source node 11 and the GND.

Further, a collector-to-emitter circuit of a sixth transistor Q6 of an NPN type for current outputting is connected between a current output node 12 and the GND. The transistor Q6 is connected at its base to the base of the second transistor Q2 and collector of the transistor Q5.

In the case where the emitter area of the transistor Q6 is as a reference (=1), the emitter area of the transistor Q2 is set to N-fold and that of the transistor Q5 is set to M-fold.

Under the application of the power source voltage Vcc, the input current Iin provides a base current of the transistor Q2 and the transistor Q1 to Q5 operate in the order of Q2→Q1→Q3→Q4→Q5.

When the base-to-emitter forward voltages of the transistors Q1 to Q5 are represented by VBEQ1 to VBEQ5, the collector currents of the transistors Q1 to Q5 by ICQ1 to ICQ5 and the collector current (output current) of the transistor Q6 by Iout, then a current of Iin-ICQ5 is supplied to the base of the transistor Q2 and the collector currents of the transistors Q1, Q3 and Q4 are increased. As a result, the collector current ICQ5 in the transistor Q2 operates toward a base current decreasing direction.

In the case of Iin<ICQ5, on the other hand, the base current in the transistor Q2 is decreased by a current corresponding to ICQ5-Iin and, therefore, the collector currents of the transistors Q1, Q3, Q4 are decreased. As a result, the collector current ICQ5 of the transistor Q5 is decreased and the base current in the transistor Q2 operates toward a base current increasing direction.

That is, a negative feedback is applied to the base of the transistors Q2 via the transistors Q2→Q1→Q3→Q4→Q5, so that the operation of the circuit becomes stable in a state corresponding to substantially Iin=ICQ5.

Here, the collector current ICQ2 of the transistor Q2, if its base current is disregarded for brevity in explanation, becomes $$ICQ2=ICQ1=ICQ3=ICQ4$$

Since ICQ5=Iin=M×ICQ4,

ICQ2=Iin/M.

Since Iout=ICQ2/N, $$Iout=\{(1/(M\cdot N)\}\cdot Iin \quad (8)$$

The output current Iout becomes a value obtained by multiplying the input current Iin by the reciprocal of a product (M×N) of the emitter area ratios (M×N) of the two transistors Q5 and Q2 of a multi-emitter configuration.

Further, since only a voltage of the base-to-emitter forward voltage VBE and the collector-to-emitter voltage VCE of the transistors (that is VBEQ1+VCEQ2 or VBEQ4+VCEQ3) is included between the power source node 11 and the GND, a low voltage operation is possible. If, for example, VBE=0.7V and the collector-to-emitter saturation voltage VCESAT=0.2V, the minimal operation voltage becomes 0.9V and the operation is possible even if Vcc falls down to 0.9V.

Figure 6:
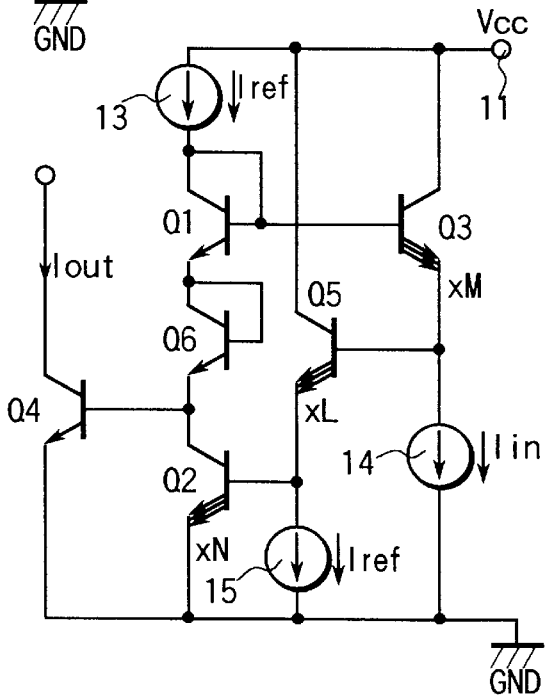
FIG. 6 is a schematic view showing a current source circuit according to a fourth embodiment of the present embodiment.

FIG. 6 shows a circuit arrangement of a current source circuit according to a fourth embodiment of the present invention. The fourth embodiment is different from the current source circuit shown in FIG. 3 in that, between the emitter of the transistor Q3 and GND, the base-to-emitter circuits of those transistors Q3 and Q5 are connected in a two-stage direct-connected configuration to provide two base-to-emitter forward voltage (VBE) and, accordingly, between the base of the transistor Q3 and that of an output transistor Q4, the base-to-emitter circuits of two diode-connected transistors Q1 and Q6 are connected in a series-connected configuration. The fourth embodiment is the same as the circuit of FIG. 3 and, in FIG. 4, the same reference numerals are employed to designate parts or elements corresponding to those shown in FIG. 3 and any further explanation is, therefore, omitted.

That is, (1) the base-to-emitter circuit of a fifth transistor Q5 of an NPN type having a multi-emitter configuration and is connected between the emitter of the transistor Q3 and the base of a transistor Q2, (2) the base-to-emitter circuit of the diode-connected transistor Q6 is inserted between the emitter of the diode-connected transistor Q1 and the base of the output transistor Q4 and (3) a current source circuit 15 flowing a bias current Iin is inserted between the emitter of the transistor Q5 and GND.

If the emitter area ratio of the transistor Q5 is represented by L when the emitter area of the output transistor Q4 is taken as a reference (=1), the base currents of the respective transistors are disregarded for brevity in explanation and β, Is of the respective transistors are equal, the following relation is established. The base potential VBEQ4 of the output transistor Q4 becomes $$VBEQ4=VBEQ2+VBEQ5+VBEQ3-VBEQ1-VBEQ6$$

$$=VT\cdot 1n[\{Iref/(N\cdot\beta\cdot Is)\}^*\ \{Iref/(L\cdot\beta\cdot Is)\}^*\ \{Iin/(M\cdot\beta\cdot Is)\}^*\ \{\beta\cdot Is/Iref\}^*\ \{\beta\cdot Is/Iref\}]$$

$$=VT\cdot 1n[Iin/(L\cdot M\cdot N\cdot\beta\cdot Is)]$$

$$=VT\cdot 1n[Iout/(\beta\cdot Is)] \quad (9)$$

$$\therefore\ Iout=\{1/(L\cdot M\cdot N)\}\cdot Iin \quad (10)$$

That is, the output Iout is proportional to the reciprocal of a product (L·M·N) of the emitter areas of the three transistors Q5, Q3, Q2 of the multi-emitter configuration.

Figure 7:
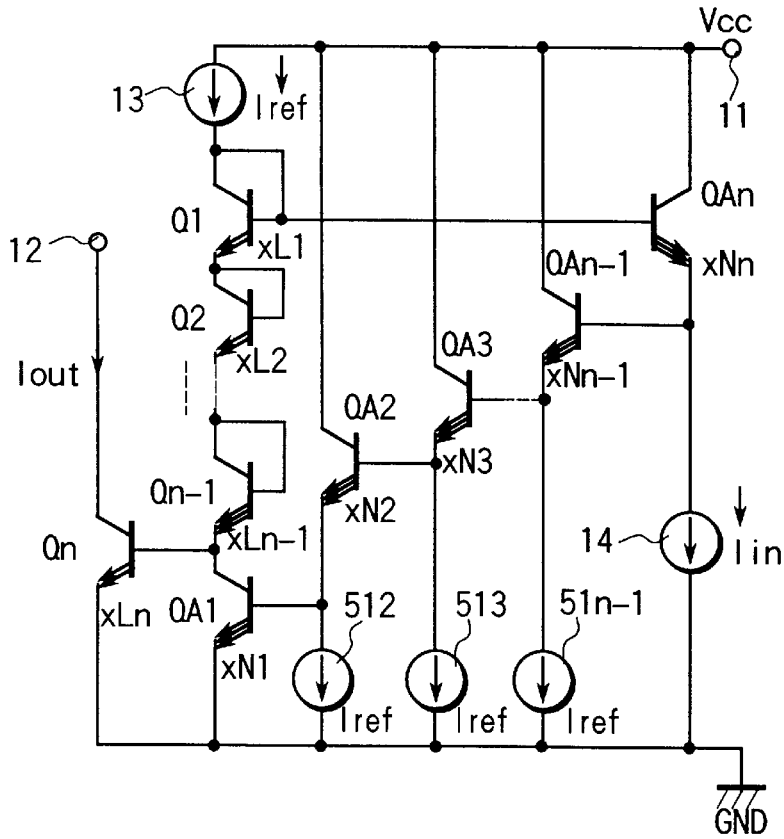
FIG. 7 is a schematic view showing a current source circuit according to a fifth embodiment of the present invention.

FIG. 7 shows a current source circuit according to a fifth embodiment of the present invention.

The fifth embodiment is different from the circuit of FIG. 6 in that, between the emitter of the transistor Q3 and the GND in FIG. 6, those base-to-emitter circuits of n transistors are connected in an n (integer)-stage direct-circuit configuration to provide n base-to-emitter forward voltages VBE and, accordingly, the base-to-emitter circuits of the n transistors are connected, in an n-stage direct-connected configuration, between the base of the transistor Q3 and the base of the output transistor Q4.

That is, between the base of an NPN type transistor QAl of a multi-emitter configuration connected at its emitter to the GND and the emitter of an NPN type transistor QAn of a multi-emitter configuration connected at its collector to a power source node, the base-to-emitter circuits of n−2 NPN type transistors QA2 to QAn−1 of a multi-emitter configuration are connected at an (n−2)-stage direct-connected configuration to provide a Darlington-connected configuration.

Current source circuits 512 to 51n−1 flowing bias currents Iref are each connected between the corresponding emitter of the n−2 transistors QA2 to QAn−1 and GND and an input current source circuit 14 for flowing an input current Iin is connected between the transistor QAn and the GND.

The base-to-emitter circuits of n−1 transistors Q1 to Qn−1 and Qn are connected between the base of the transistor QAn and the GND to provide a corresponding-stage direct-circuit configuration, those transistors Q1 to Qn−1 being each connected as a diode connection and the transistor Qn serves as an output transistor.

Between the power source node 11 and the collector of the transistor Q1 a reference current source circuit 13 is connected to provide a reference current Iref.

If the emitter areas of the Darlington-connected transistors QA1 to QAn are represented by N1 to Nn, the emitter area ratio of the diode-connected transistors Q1 to Qn−1 by L1 to Ln−1 and the area ratio of the output transistor Qn by Ln, the base current of the respective transistors are disregarded for brevity in explanation and β, Is of the respective transistors are equal, then the following relation is established.

The base potential VBEQn of the output transistor Qn becomes $$VBEQn=VBEQA1+VBEQA2+\ldots+VBEQAn-1+VBEQAn-VBEQ1-VBEQ2-\ldots-VBEQn-1$$

$$=VT\cdot 1n[\{Iref/(N1\cdot\beta\cdot Is)\}^*\ \{Iref/(N2\cdot\beta\cdot Is)\}^*\ \ldots\ ^*\ \{Iref/(Nn-1\cdot\beta\cdot Is)\}^*\ \{Iin/(Nn\cdot\beta\cdot Is)\}^*\ \{L1\cdot\beta\cdot Is/Iref\}^*\ \{L2\cdot\beta\cdot Is/Iref\}^*\ \ldots\ ^*\ \{Ln-1\cdot\beta\cdot Is/Iref\}]$$

$$=VT\cdot 1n[\{(L1\cdot L2\cdot\ldots\cdot Ln-1)/(N1\cdot N2\cdot\ldots\cdot Nn-1\cdot Nn)\}^*\ \{Iin/\beta\cdot Is\}]$$

$$=VT\cdot 1n\{Iout/(Ln\cdot\beta\cdot Is)\} \quad (11)$$

$$\therefore Iout=\{(L1\cdot L2\cdot\ldots\cdot Ln-1\cdot Ln)/(N1\cdot N2\cdot\ldots\cdot Nn-1\cdot Nn)\}\cdot Iin \quad (12)$$

That is, relative to the input current Iin, the output current Iout becomes proportional to a product (L1·L2·. . . ·Ln−1·Ln) of the emitter ratios of the n−1 transistors Q1 to Qn−1 and Qn and proportional to the reciprocal of a product (N1·N2·. . . ·Nn−1·Nn) of the n transistors QA1 to QAn of the multi-emitter configuration.

Here, L1=L2=L3=. . . $L_{n-1}$ =Ln=1. Then $$Iout=\{1/(N1\cdot N2\cdot\ldots\cdot N_{n-1}\cdot Nn)\}\cdot In \quad (13)$$

That is, relative to the input current Iin, the output current Iout becomes proportional to the reciprocal of a product (N1·N2·. . . ·$N_{n-1}$·Nn) of the emitter area ratios of the n transistors QA1 to QAn of the multi-emitter configuration.

Figure 8:
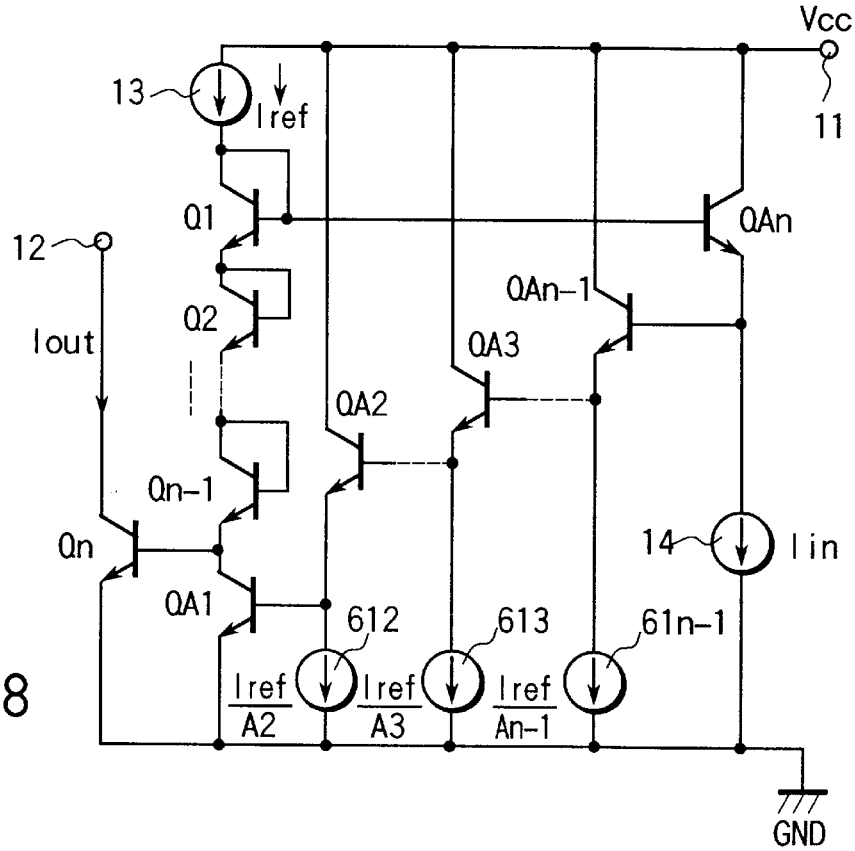
FIG. 8 is a schematic view showing a current source circuit according to a sixth embodiment of the present embodiment.

FIG. 8 shows a current source circuit according to a sixth embodiment of the present invention.

The sixth embodiment is different from the current source circuit of FIG. 7 in that, with the emitter area ratios of respective transistors represented as 1, current source circuits 612 . . . 61n−1 are so connected to the emitters of those transistors QA2 . . . QAn−1 of n transistors QA1 . . . AQn of a Darlington connection as to be given corresponding weighted currents Iref/A2 . . . Iref/An−1. The remaining portion of the circuit of FIG. 8 is the same as that of FIG. 7 and any further explanation is omitted with the same reference numerals used to designate parts or elements corresponding to those shown in FIG. 7.

If, for brevity in explanation, the base current of the respective current is disregarded and β, Is of the respective transistors are equal, then the following relation is established.

The base potential VBEQn of the output transistor Qn becomes $$VBEQn=VBEQA1+VBEQA2+\ldots+VBEQAn-1+VBEQAn-VBEQ1-VBEQ2-\ldots-VBEQn-1$$

$$=VT\cdot 1n[\{Iref/(\beta\cdot Is)\}^*\ \{Iref/(A2\cdot\beta\cdot Is)\}^*\ \ldots\ ^*\ \{Iref/(An-1\cdot\beta\cdot Is)\}^*\ \{Iin/(\beta\cdot Is)\}^*\ \{\beta\cdot Is/Iref\}^*\ (\beta\cdot Is/Iref)\ ^*\ \ldots\ ^*\ \{\beta\cdot Is/Iref\}]$$

$$=VT\cdot 1n[\{1/(A2\cdot\ldots\cdot An-1)\}^*\ \{Iin/(\beta\cdot Is)\}]$$

$$=VT\cdot 1n\{Iout/(\beta\cdot Is)\} \quad (14)$$

$$\therefore Iout=\{1/(A2\cdot\ldots\cdot An-1)\}\cdot Iin \quad (15)$$

Relative to an input current Iin, the output current Iout is proportional to the reciprocal of a product (A2·A3·. . . ·An−1) of the weighting coefficients of the current source circuits 612 . . . 61n−1. Here, if (A2·A3·. . . An−1)>1 is given, the output current Iout smaller than the input current Iin is obtained. If, however, (A2·A3·. . . An−1)<1 is given, the output current Iout greater than the input current Iin is obtained.

Figure 9:
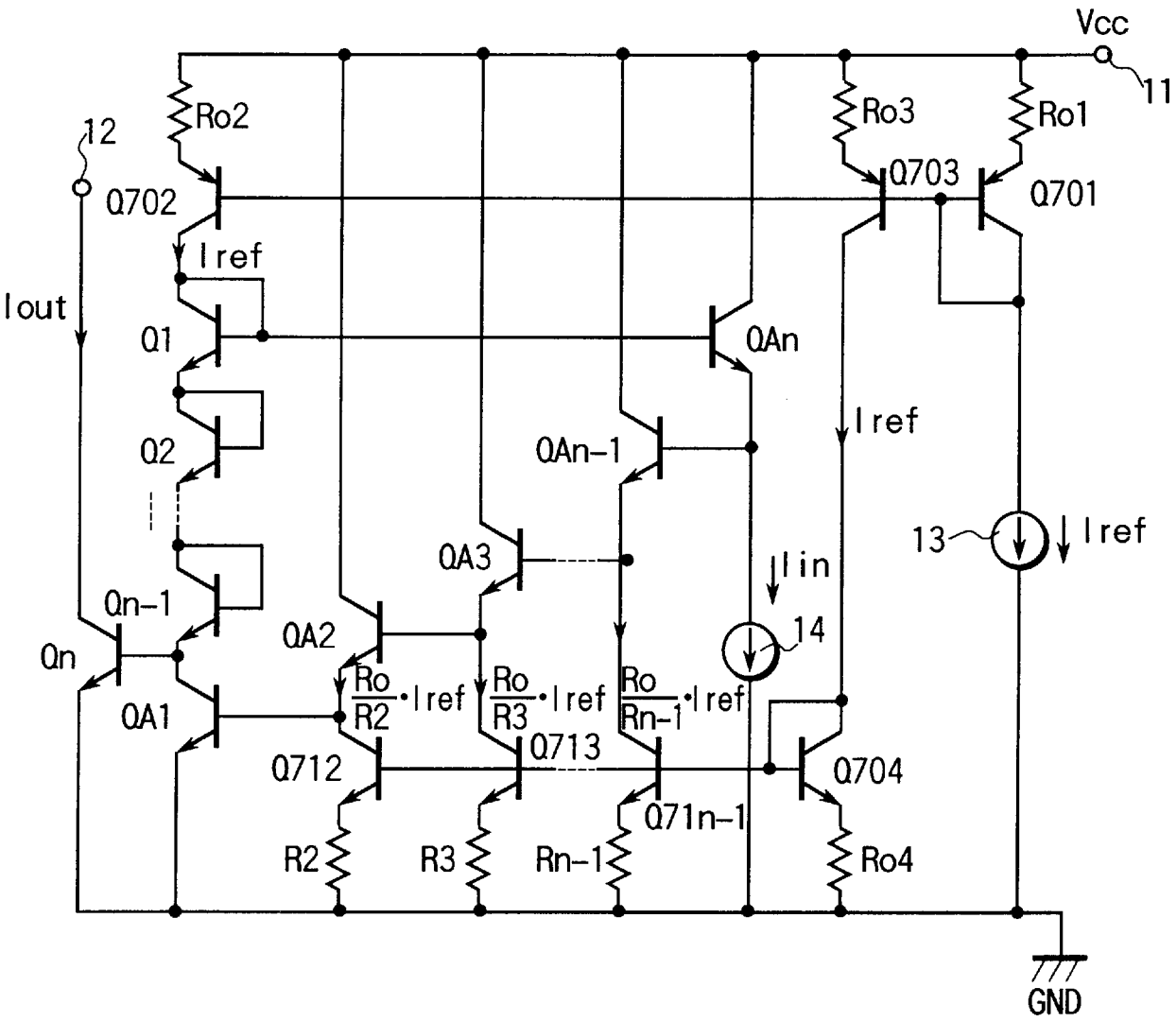
FIG. 9 is a schematic view showing a current source circuit according to a seventh embodiment of the present embodiment.

FIG. 9 shows a current source circuit according to the seventh embodiment of the present embodiment.

A practical form of a circuit is of such a type that resistive elements R2, R3, . . . Rn−1 are used to produce the reference current Iref in the reference current source circuit 13 and the weighted currents Iref/A2 . . . Iref/An−1 in the current source circuits 612 . . . 61n−1 connected to the emitters of the transistors QA2 . . . QAn−1 of the n transistors QA1 . . . QAn of the Darlington connection. Here, the same reference numerals are employed to designate parts or elements corresponding to those in FIG. 8 and any further explanation is omitted.

A first resistive element R01, the emitter-to-collector circuit of a PNP transistor Q701 having its base and collector connected to each other and reference current source 13 flowing a reference current Iref are connected, in a series array, between a power source node 11 and GND.

A second resistive element R02 and emitter-to-collector circuit of a PNP transistor Q702 are series-connected between the power source node 11 and the collector of the diode-connected transistor Q1.

A third resistive element R03, emitter-to-collector circuit of a PNP transistor Q703, collector-to-emitter circuit of an NPN transistor Q704 having its collector and base connected together and a fourth resistive element R04 are series-connected between the power source node 11 and the GND.

The PNP transistors Q701, Q702 and Q703 have their bases connected together to provide a first current mirror circuit.

Between the respective emitter of the transistors QA2 . . . QAn−1 of the n transistors QAl to QAn of a Darlington connection and the GND, a corresponding current source is connected. Those respective current source circuits are comprised of the collector-to-emitter paths of series-connected NPN transistors Q712 to Q71n−1 and resistive elements R2 to Rn−1.

The NPN transistors Q712 to Q71n−1 and Q704 have their bases connected together to provide a second current mirror circuit.

Assuming $R_{01}=R_{02}=R_{03}=R_{04}=R_0$ in FIG. 9, those resistive ratios (R2/R0), (R3/R0) . . . , (Rn−1/R0) in FIG. 9 correspond to the weighted coefficients A2, . . . , An−1 of those current source circuits 612 . . . 61n−1 in FIG. 8 and hence $$Iout=(R0^{n-2}/R2\cdot\ldots\cdot Rn-1)\cdot Iin \quad (16)$$

That is, relative to the input current Iin, the output current Iout is proportional to the (n−2)nd power of the resistive value of the resistive element R0 and proportional to the reciprocal of a product of the weighted coefficients of those resistive elements R2·R3·. . . ·Rn−1.

If (R2·. . . ·Rn−1l)>R$0^{n-2}$, then an output current Iout smaller than Iin is obtained, while, on the other hand, if (R2·. . . ·Rn−1)<R$0^{n-2}$, the output current Iout greater than the input current Iin is obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A current source circuit comprising:

a series-circuit connected between a power supply node and ground comprising, a reference current source circuit, a first transistor having an NPN configuration and having its collector and base connected to each other and a second transistor having an emitter area N-fold a reference area, wherein N is greater than 1;

a third transistor having an NPN configuration and connected to the power supply node at its collector, connected to the base of the first transistor connected to the base of the second transistor at its emitter, and having an emitter area M-fold the reference area, wherein M is greater than 1;

an input current source circuit connected between the emitter of the third transistor and the ground to provide an input current; and a fourth transistor having an NPN configuration and having an emitter area equal to the reference area and having its collector-to-emitter circuit connected between a current output node and the ground and its base connected to the collector of the second transistor in order to provide an output current, wherein the output current relative to the input current is proportional to a reciprocal of a product M×N of the emitter areas of the second and third transistors.

2. The current source circuit according to claim 1, wherein the emitter area of the fourth transistor is one and an emitter area of the first transistor is n-fold the reference area.

3. The current source circuit according to claim 2, wherein the emitter area of the first transistor is n=1-fold the reference area.

4. The current source circuit according to claim 1, wherein the input current source circuit comprises a resistor.

5. A current source circuit comprising:

a first group of n−1 transistors (Q1, Q2, . . . , Qn−1) of an NPN type having one end connected to an other end of a reference current source circuit having one end connected to a power source node, having their collector and base connected to each other, having their emitter area ratios L1 . . . Ln−1 and each having a multi-emitter configuration, these transistors being series-connected together and each providing a diode connection;

an output transistor Qn of a multi-emitter configuration having its collector-to-emitter circuit connected between a current output node and a ground and its base connected to the emitter of the transistor Qn−1 at the other end of the first transistor group and having an emitter area ratio Ln, the output transistor Qn providing an output current Iout;

a second group of transistors (QA1, QA2, . . . , QAn) comprising a first transistor QA1 of an NPN type having its collector-to-emitter circuit connected between the emitter of the transistor Qn−1 at the other end of the first group of transistors and ground and having a multi-emitter configuration, an n-th transistor QAn of an NPN type having its collector connected to the power source node and its base connected to the base of one transistor of the first transistor group and having a multi-emitter configuration, and n−2 transistors of an NPN type having a multi-emitter configuration and Darlington-connected between the base of the first transistor QA1 and the emitter of the n-th transistor QAn said second group of transistors (QA1, QA2, . . . QAn) having their emitter area N1, N2, . . . Nn, wherein the collector-to-emitter circuits of the second to (n−1)-st transistors (QA2, . . . , QAn−1) of the second transistor group are connected between the power source node and the ground;

an input current source circuits connected between the emitter of the n-th transistor QAn and the ground to provide an input current Iin; and n−2 bias current source circuits connected between the corresponding emitters of the second to the n−1 transistors (QA2, . . . , QAn−1) of the second transistors group and the ground, wherein, relative to the input current Iin, the output current Iout is proportional to a product (L1·L2·. . . ·Ln) of those emitter area ratios of those diode-connected n−1 transistors Q1 to Qn−1 and output transistor Qn and proportional to the reciprocal of a product (N1·N2·. . . ·Nn−1·Nn) of the emitter area ratios of the second transistor group (QA1, QA2, . . . , QAn) where n represents an integer of over 2.

6. A current source circuit comprising:

a reference current source circuit having one end connected to a power source node;

a first group of n−1 transistors (Q1, Q2, . . . , Qn−1) of an NPN type having one end connected to the other end of the reference current source circuit, each having its collector and base connected to each other, and series-connected together as a diode connection each;

an output transistor Qn connected between a current output node and ground and connected at its base connected to the emitter of the transistor Qn−1 at the other end of the first transistor group to provide an output current Iout;

a second group of transistors (QA1, QA2, . . . , QAn) comprising a first transistor QA1 of an NPN type having a collector-to-emitter circuit connected between the emitter of the transistor Qn−1 at the other end of the first transistor group and ground, an n-th transistor QAn of an NPN type connected at its collector to the power source node and at its base connected to the base of one transistor of the first transistor group, and n−2 transistors of an NPN type Darlington-connected between the base of the first transistor QA1 and the emitter of the n-th transistor QAn, wherein the collector-to-emitter circuits of the second to the (n−1)-st transistors (QA2, . . . , QAn−1) of the second transistor group are connected between the power source node and the ground;

n−2 bias current source circuits connected between the corresponding emitters of the second to (n−1)-st transistors (QA2, . . . , QAn−1) of the second transistor group and the ground to provide those corresponding weighted currents (Iref/A2, Iref/A3, . . . , Iref/An−1 where A2, A3, . . . , An−1 represent the weighted factors); and an input current source circuit connected between the emitter of the n-th transistor QAn and the ground to provide an input current Iin, wherein the output current Iout is proportional to the reciprocal of a product (A2·A3·. . . ·An−1) of the weighted factors given to the n−2 bias current source circuits for allowing a flow of the corresponding weighted currents (Iref/A2, Iref/A3, . . . , Iref/An−1) relative to the input current Iout.

7. The current source circuit according to claim 6, wherein the n−2 bias current source circuits include resistive elements of those levels of currents of the corresponding weighted factors in the bias current source circuits.

8. The current source circuit according to claim 1, wherein said second and third transistors have multi-emitter configurations.

* * * * *